US011220847B2

(12) United States Patent
Nelsen et al.

(10) Patent No.: US 11,220,847 B2
(45) Date of Patent: Jan. 11, 2022

(54) LATCH MECHANISM

(71) Applicants: GM Global Technology Operations LLC, Detroit, MI (US); Kiekert AG, Heiligenhaus (DE)

(72) Inventors: James N. Nelsen, Howell, MI (US); Joseph Michael Phares, West Bloomfield Township, MI (US); David Fischer, Milford, MI (US)

(73) Assignees: GM GLOBAL TECHNOLOGY OPERATIONS LLC, Detroit, MI (US); KIEKERT AG, Heiligenhaus (DE)

( * ) Notice: Subject to any disclaimer, the term of this patent is extended or adjusted under 35 U.S.C. 154(b) by 728 days.

(21) Appl. No.: 16/105,079

(22) Filed: Aug. 20, 2018

(65) Prior Publication Data

US 2020/0056406 A1 Feb. 20, 2020

(51) Int. Cl.
*E05B 77/38* (2014.01)
*E05B 85/24* (2014.01)
(Continued)

(52) U.S. Cl.
CPC ..... *E05B 77/38* (2013.01); *E05B 77/40* (2013.01); *E05B 83/00* (2013.01); *E05B 85/24* (2013.01)

(58) Field of Classification Search
CPC ..... E05B 77/36; E05B 77/38; E05B 77/40; E05B 79/04; E05B 83/00; E05B 85/24;
(Continued)

(56) References Cited

U.S. PATENT DOCUMENTS 2,877,038 A 3/1959 Kramer
4,165,112 A * 8/1979 Kleefeldt ..... E05B 85/045 292/216
(Continued)

FOREIGN PATENT DOCUMENTS

JP 3576311 B2 * 10/2004 ..... E05B 77/38
JP 3576311 B2 10/2004
(Continued)

OTHER PUBLICATIONS

U.S. Appl. No. 15/693,809, First Named Inventor: John Perring, "Latch Mechanism for a Vehicle," filed on Sep. 1, 2017.
(Continued)

*Primary Examiner* — Kristina R Fulton
*Assistant Examiner* — Christopher F Callahan
(74) *Attorney, Agent, or Firm* — Vivacqua Crane PLLC

(57) ABSTRACT

A service latch assembly for a vehicle is disclosed. The latch assembly includes a striker member and a latch mechanism configured to selectively engage and release the strike member. The latch mechanism includes a frame plate defining a guideway configured to receive the striker member, a striker guard inserted into the guideway, a latch member pivotally connected to the frame plate, a stop tab extending from a closed end of the guideway, a stop bumper inserted onto the stop tab, and an over-mold fitted over the latch member. The over-mold includes a pivot limiter bumper configured to cooperate with the stop bumper to limit the pivot of the latch member in an open position and a striker retention feature nested onto an edge retention surface of a first lever arm of the latch member.

17 Claims, 3 Drawing Sheets

(51) Int. Cl.
*E05B 77/40* (2014.01)
*E05B 83/00* (2014.01)

(58) Field of Classification Search
CPC . E05B 15/022; E05B 15/0225; Y10T 292/688
See application file for complete search history.

(56) References Cited

U.S. PATENT DOCUMENTS 4,466,645 A * 8/1984 Kobayashi ..... E05B 85/045 292/216
4,756,563 A * 7/1988 Garwood ..... E05B 85/243 292/216
4,875,724 A 10/1989 Gruber
4,941,696 A * 7/1990 Yamada ..... E05B 77/38 292/216
5,209,531 A * 5/1993 Thau ..... E05B 85/045 292/216
5,308,128 A * 5/1994 Portelli ..... E05B 77/265 292/216
5,727,825 A * 3/1998 Spurr ..... E05B 77/38 292/341.12
5,738,393 A 4/1998 Chao
6,024,389 A * 2/2000 Arabia, Jr. ..... E05B 85/243 292/216
6,386,599 B1 5/2002 Chevalier
7,306,269 B2 12/2007 Cetnar et al.
8,474,883 B2 7/2013 Konchan
2005/0062295 A1 3/2005 Ketelsen et al.
2006/0087126 A1 4/2006 Roussel
2008/0202176 A1 8/2008 Inan et al.
2008/0295416 A1* 12/2008 Kintz ..... E05C 3/30 49/506
2012/0193966 A1 8/2012 Matsuura et al.

FOREIGN PATENT DOCUMENTS

KR 2009-0000084 U 1/2009
WO WO-2004101920 A1 * 11/2004 ..... E05B 77/38
WO WO-2006133673 A1 * 12/2006 ..... E05B 77/38
WO 2008061366 A1 5/2008
WO WO-2008061366 A1 * 5/2008 ..... E05B 77/38
WO WO-2015160015 A1 * 10/2015 ..... B60N 2/08
WO WO-2016067479 A1 * 5/2016 ..... E05B 77/38
WO WO-2017082235 A1 * 5/2017 ..... B60N 2/20

OTHER PUBLICATIONS

U.S. Appl. No. 15/871,568, First Named Inventor: James N. Nelsen, "Latch Mechanism for a Vehicle," filed on Jan. 15, 2018.

* cited by examiner

LATCH MECHANISM

INTRODUCTION

The present disclosure relate to a latch assembly for a motor vehicle, more particularly to a service latch mechanism for the motor vehicle.

A removable panel of a motor vehicle, such as a service panel, is configured to selectively cover a service compartment of the motor vehicle. Service panels may include relatively small panels such as a snap-on cover for covering a fuse box and a trunk floor panel for covering a spare tire well. Service panels may also include relatively large panels such as that of a hinged window panel that is configured to be opened for urgent access to a passenger compartment of the vehicle and a service panel for access to a bank of batteries for an electric vehicle. Service latch assemblies are provided for maintaining such relatively large panels in a secure closed position and for selective opening of the panels on infrequent occasions to access the compartments.

A typical service latch assembly is designed to be normally in the engaged position where the panel is retained in the closed position covering the compartment. The service latch assembly is also designed to be selectively disengaged on an infrequent to gain access to the service compartment. The service latch assembly includes a striker member located on the service panel and a latch mechanism located on an interior surface of the compartment. The latch mechanism may be operated by an electronic actuator and/or release cable for selectively disengaging the striker member. However, the service latch assembly may contribute to undesirable vehicle noise, vibration, and harshness caused by the striker member clashing against the latch mechanism while the motor vehicle is in motion on rough driving surfaces.

Thus, while current services latch assemblies achieve their intended purpose, there is a need for an improved latch assembly that provides a superior latching ability while minimizing noise, hardness, and vibration during the operation of the vehicle, yet contains a minimum number of parts of relatively inexpensive construction, thus improving economy of manufacture and assembly.

SUMMARY

According to several aspects, a latch mechanism is disclosed. The latch mechanism includes a frame plate defining a guideway having an open end configured to receive a striker member and an opposite closed end, a latch member pivotally connected to the frame plate, a stop tab extending from the closed end of the guideway, and a stop bumper. The stop bumper defines a slot configured to receive the stop tab. The stop tab is inserted through the slot thus retaining the stop bumper on the stop tab. The latch member is biased to pivot into a closed position and configured to selectively pivot into an open position.

In an additional aspect of the present disclosure, the latch member includes a first lever arm having an interior edge surface configured to engage the stop bumper to limit the pivot of the latch member in the closed position.

In another aspect of the present disclosure, the latch mechanism further includes an over-mold fitted over the latch member. The over-mold includes a pivot limiter bumper configured to cooperate with the stop bumper to limit the pivot of the latch member in open position.

In another aspect of the present disclosure, the latch member includes a first lever arm having a catch end having an edge retention surface configured to retain the striker member, and wherein the over-mold includes a striker retention feature nested onto the edge retention surface In another aspect of the present disclosure, the latch mechanism further includes a striker guard inserted onto the guideway.

In another aspect of the present disclosure, the striker guard includes a pair of side surfaces. At least one of the side surfaces includes a projection configured to engage a corresponding notch defined in the guideway.

In another aspect of the present disclosure, the slot of the stop bumper includes a plurality of internal ribs compressed onto the stop tab.

In another aspect of the present disclosure, the stop tab includes an edge surface defining a protrusion spaced from a distal end of the stop tab. The stop bumper is retained on the stop tab between the frame plate and the protrusion.

In another aspect of the present disclosure, the latch member includes a first lever arm and a second lever arm extending from an end of the first lever arm. The latch member is pivotally attached to the frame plate with a pivot bearing located between the first lever arm and second lever arm.

In another aspect of the present disclosure, the latch mechanism further includes a torsion spring disposed on the pivot bearing. The torsion spring includes a first end retained in a detent notch defined in the stop tab and a second end engaged to the second lever arm of the latch member urging the latch member into the closed position.

According to several aspects, a latch assembly having striker member is disclosed. The latch assembly includes a mounting bracket having a frame plate and a pair of mounting members extending from the frame plate. The frame plate defines a guideway having an opened end, a closed end opposite the opened end, and a pair of side surfaces extending between the opened end and closed end. A latch member is pivotally connected to the frame plate, wherein the latch member is configured to pivot into a closed position and into an opened position. A stop bumper is disposed adjacent the closed end, wherein the stop bumper is configured to limit the travel of the striker member within the guideway and to limit the pivot of the latch member in the closed position.

In another aspect of the present disclosure, the latch assembly further includes a striker guard having an interior surface defining a U-shape and a pair of side surfaces extending from the interior surface along the parallel legs of the U-shape. The striker guard is inserted into the guideway such that the interior surface abuts the frame plate and the pair of side surfaces abuts the edge surfaces of the guideway.

According to several aspects, the latch assembly further includes an over-mold fitted over the latch member. The over-mold includes a pivot limiter bumper configured to cooperate with the stop bumper to limit the pivot of the latch member in the open position and a striker retention feature configured to engage the striker member.

According to several aspects, the latch member includes a catch end defining an exterior cam surface transitioning through an apex surface to an edge retention surface.

According to several aspects, the latch member includes a first lever arm having an interior edge surface configured to engage the stop bumper to limit the pivot of the latch member in the closed position.

According to several aspects, the latch member further includes a second lever arm extending from an end of the first lever arm and a pivot bearing at the intersection of the first and second lever arms.

According to several aspects, a service latch assembly for a vehicle is disclosed. The service latch assembly includes a frame plate defining a guideway configured to receive a striker member, the guideway includes an open end and a closed end opposite the open end; a latch member pivotally connected to the frame plate, where the latch member is biased to pivot into a closed position and configured to selectively pivot into an open position; a stop tab extending from the closed end of the guideway; a stop bumper defining a slot configured to receive the stop tab, wherein the stop tab in inserted through the slot thus retaining the stop bumper on the stop tab; and an over-mold fitted over the latch member, wherein the over-mold includes a pivot limiter bumper configured to cooperate with the stop bumper to limit the pivot of the latch member in open position.

In an additional aspect of the present disclosure, the latch member includes a first lever arm having a catch end having an edge retention surface configured to retain the striker member and an internal surface configured to engage the stop bumper to limit the pivot of the latch member in the closed position.

In another aspect of the present disclosure, the over-mold further includes a striker retention feature nested onto the edge retention surface of the first lever.

In another aspect of the present disclosure, the latch assembly further includes a striker guard having an interior surface defining a U-shape and a pair of side surfaces extending from the interior surface along the parallel legs of the U-shape. The interior surface is abutted against the frame plate and the pair of side surfaces are interference fitted into the guideway.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale and some features may be exaggerated or minimized to show details of particular features. The specific structural and functional details disclosed are not intended to be interpreted as limiting, but as a representative basis for teaching one skilled in the art as to how to practice the disclosed concepts.

Figure 1:
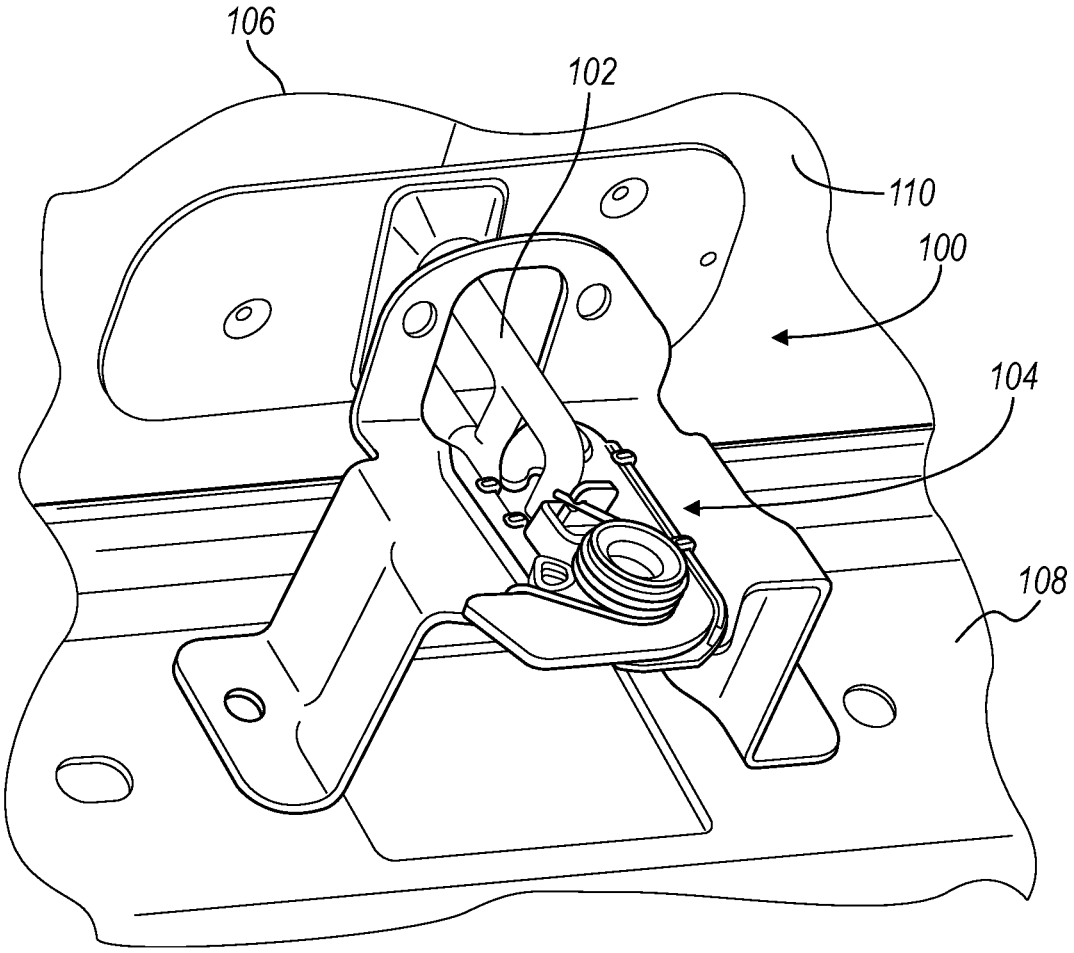
FIG. 1 is a perspective view of a latch assembly having a striker member and latch mechanism according to an exemplary embodiment.

Referring to FIG. 1, is a latch assembly, generally indicated by reference character 100, having a striker member 102 and a latch mechanism, generally indicated by reference character 104. The latch mechanism 104 is configured to cooperate with the striker member 102 to selectively fasten a panel 106 proximal to a compartment of a vehicle such that the panel 106 maintains closure of the compartment. The latch mechanism 104 is also configured to selectively release the striker member 102 thus allowing access to the compartment on an infrequent as needed basis. The latch assembly 100 is ideal for use in hinged vehicle panels that are not routinely accessed during the normal operation of the vehicle. Examples of such vehicle panels include, but are not limited to, a service panel covering a service compartment of the vehicle, an emergency access panel to a passenger compartment, and the rear fixed window of a sport utility vehicle.

In the embodiment shown, the latch mechanism 104 is mounted on an interior surface 108 of the compartment adjacent the opening of the compartment and the striker member 102 is mounted on the interior surface 110 of the panel 106 adjacent the latch mechanism 104 when the panel 106 is in a closed position. It should be appreciated that the striker member 102 may be mounted on an interior surface of the compartment adjacent the opening and the latch mechanism 104 may be mounted on the interior surface of the panel without departing from the scope of the invention. The striker member 102 is shown received in and engaged to the latch mechanism 104 such that the panel 106 is secured in the closed position covering the opening of the compartment. The striker member 102 is shown as a circular rod or bar movable in a generally linear direction toward the latch mechanism 104.

Figure 2:
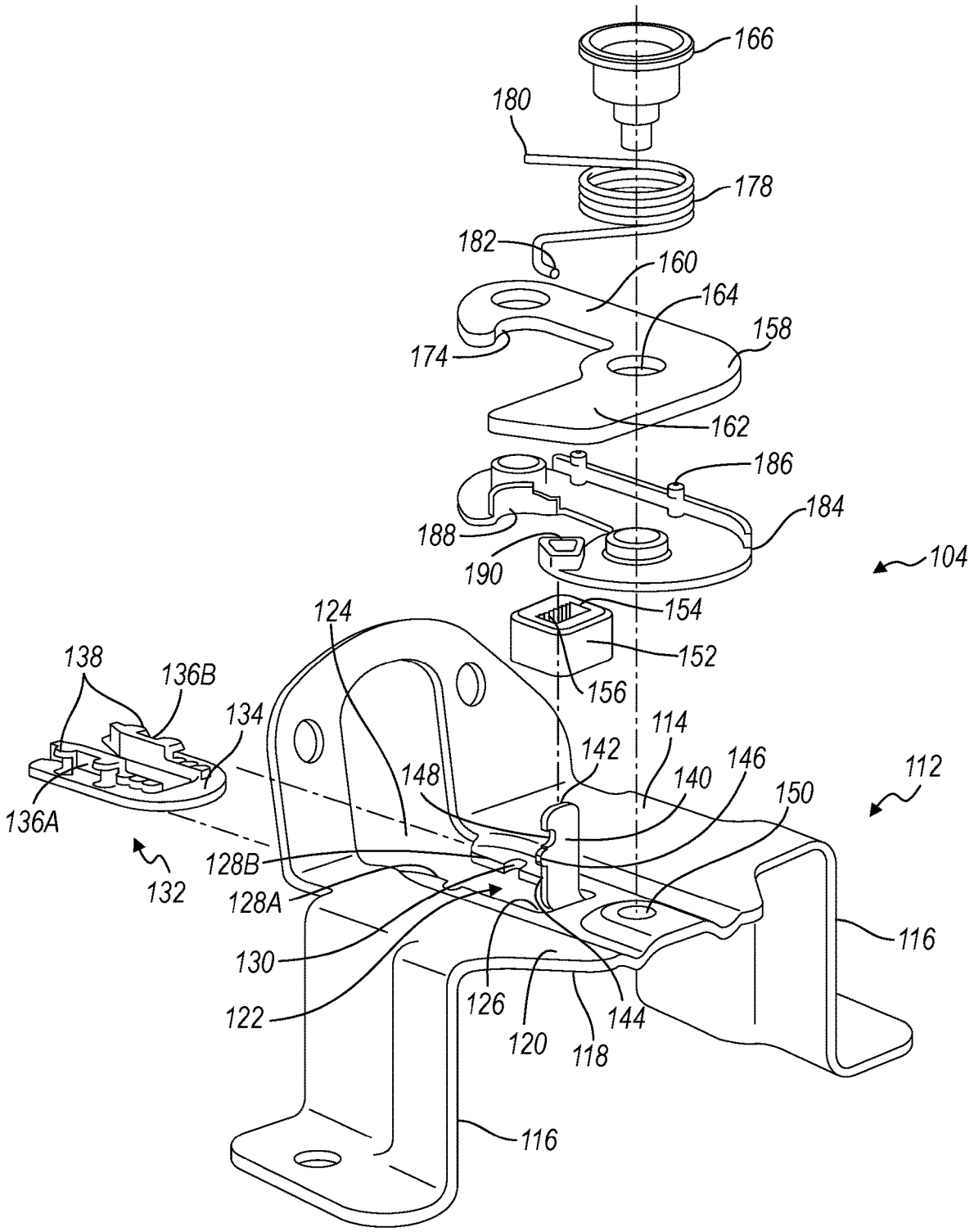
FIG. 2 is an exploded perspective view of the latch mechanism of FIG. 1 according to an exemplary embodiment.
Figure 3:
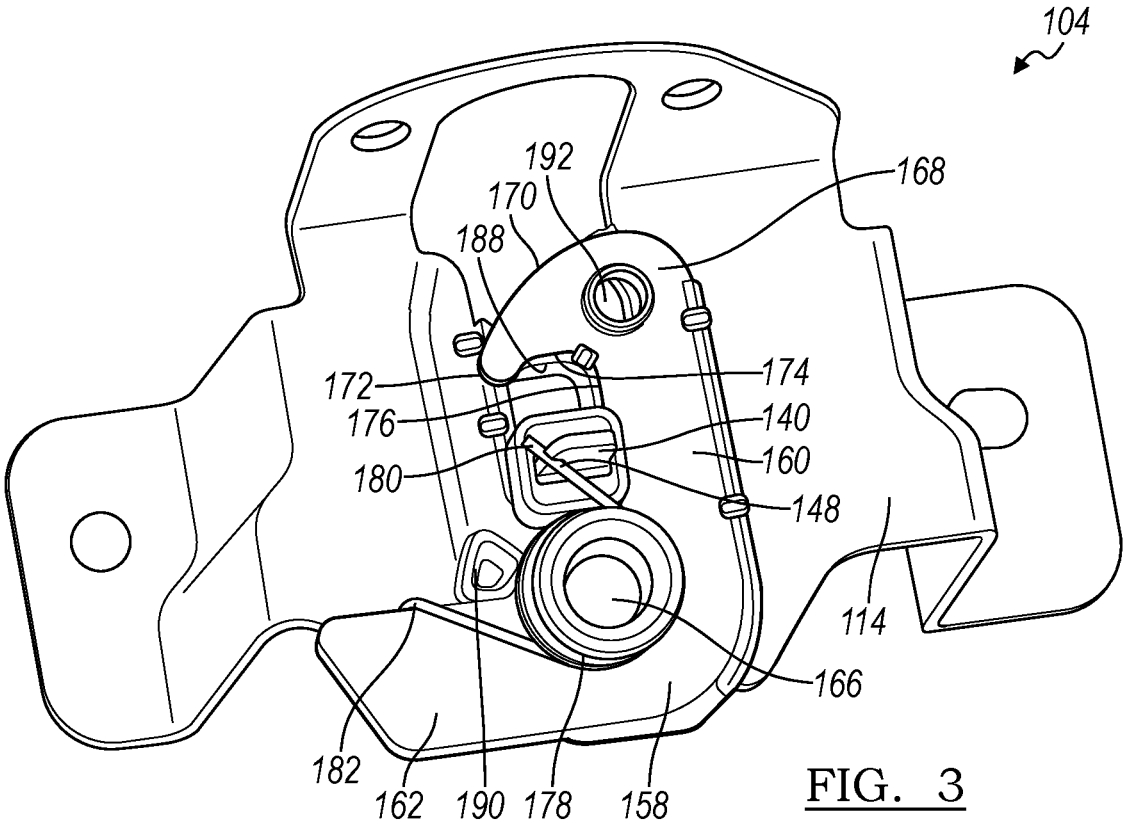
FIG. 3 is a perspective view of the latch mechanism of FIG. 1 in a first position according to an exemplary embodiment.
Figure 4:
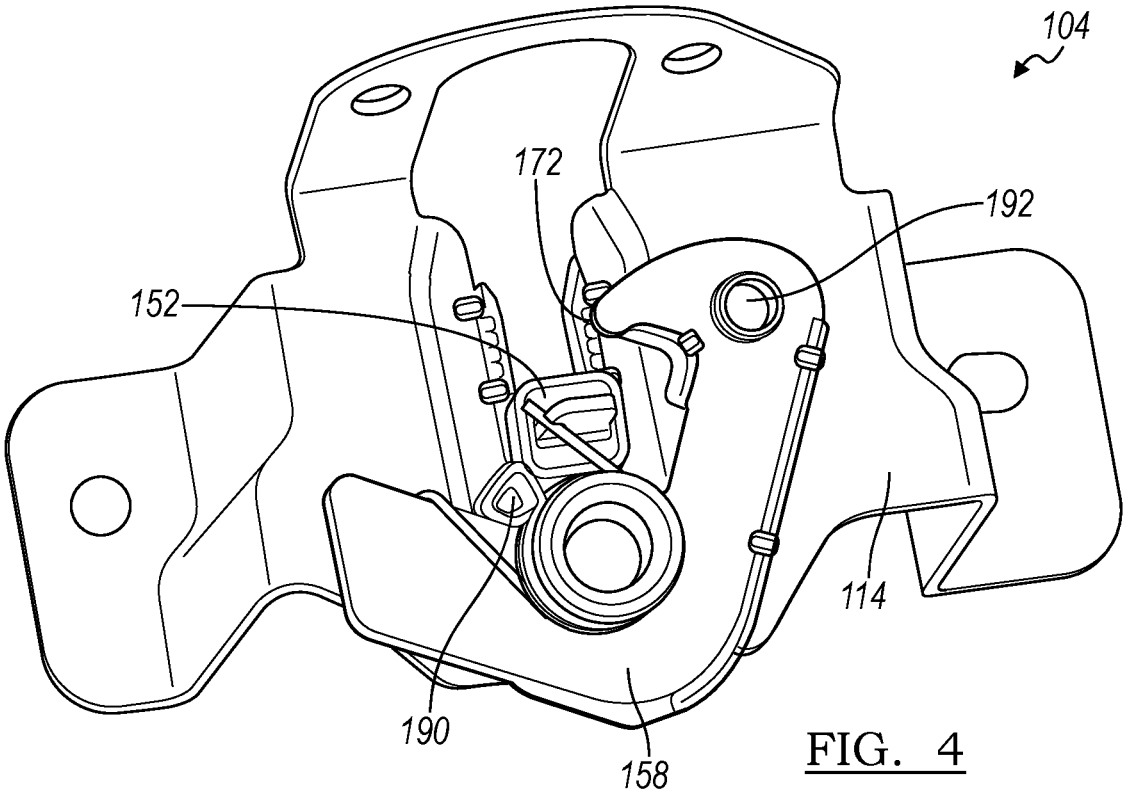
FIG. 4 is a perspective view of the latch mechanism of FIG. 1 in a second position according to an exemplary embodiment.

Referring to FIG. 2, an exploded perspective view of the latch mechanism 104 is show. The latch mechanism 104 includes a mounting bracket, generally indicated by reference character 112, having a frame plate 114 and a pair of mounting members 116 extending from the frame plate 114. The frame plate 114 includes an interior surface 118, shown as the bottom surface 118, and an exterior surface 120, shown as the top surface 120. The frame plate 114 defines a guideway 122 having an opened end 124 configured to receive the striker member 102 and a closed end 126 opposite the opened end 124. The closed end 126 is configured to limit the travel of the striker member 102 into the latch mechanism 104. The guideway 122 includes a first edge surface 128A and a second edge surface 128B facing the first edge surface 128A. Each of the first and second edge surfaces 128A, 128B extends from the opened end 124 to the closed end 126 of the guideway 122 and defines a notch 130 configured to receive a corresponding feature on a striker guard 132.

The striker guard 132 includes an interior surface 134 defining a U-shape and a pair of side surfaces 136A, 136B extending from the interior surface along the parallel legs of the U-shape. The striker guard 132 is inserted into the guideway 122 and placed in a predetermined position where the interior surface 134 abuts the interior surface 118 (bottom surface 118) of the frame plate 114 and the pair of side surfaces 136A, 136B abuts the corresponding edge surfaces 128A, 128B of the guideway 122. Each of the pair of side surfaces 136A, 136B includes a projection 138 configured to be insertable into the notch 130 located in the corresponding edge surfaces 128A, 128B such that the striker guard 132 is maintained in the predetermined position within the guideway 122. The striker guard 132 is formed of a non-brittle plastic material having sufficient structural rigidity to maintain its form after assembly and having sufficient resilience to dampen undesirable vibrations caused by the striker member 102 acting against the latch mechanism 104.

A stop tab 140 extends from the closed end 126 of the guideway 122 in a direction perpendicularly away from the exterior surface 120 of the frame plate 114. The stop tab 140 includes a distal end 142 and an edge surface 144 extending from the frame plate 114 to the distal end 142. The edge surface 144 defines a protrusion 146 proximal to the distal end 142 and a detent notch 148 between the protrusion 146 and distal end 142. Proximal to the stop tab 140 on the opposite side of the guideway 122, is a through-hole 150 defined through the frame plate 114.

The latch mechanism 104 includes a stop bumper 152 defining an interior slot 154 having a plurality of internal ribs 156. The stop bumper 152 is made of a rubber/elastomer material configured to absorb the impact of the striker member 102 upon the closing of the panel 106 and to dampen any undesirable vibrations of the striker member 102 when engaged to the latch mechanism 104. The stop tab 140 is inserted through the slot 154 such that the stop bumper 152 is securely retained between the frame plate 114 and the protrusion 146. The ribs 156 are partially compressed against the stop tab 140 thus assisting in the securing of the stop bumper 152 to the stop tab 140, as well as providing additional damping when the striker member 102 engages the stop bumper 152.

The latch mechanism 104 includes a latch member 158 pivotally connected to the frame plate 114. The latch member 158 includes a first lever arm 160 and a second lever arm 162 extending perpendicularly from an end of the first lever arm 160. FIGS. 1 through 4 shows the latch member 158 having a reversed L-shape when viewed toward the frame plate 114. The latch member 158 defines a through-hole 164 at the pivot point of the latch member 158. The pivot point is located proximal to a portion of the latch member 158 where the first lever arm 160 intersects with the second lever arm 162. The through-hole 164 of the latch member is coaxially aligned with the through-hole 150 defined in the frame plate 114 and attached to the frame plate with a pivot bearing 166. The pivot bearing 166 is inserted through the through-holes 150, 164 pivotally attaching the latch member 158 to the frame plate 114. Best shown in FIGS. 3 and 4, the latch member 158 is pivotable in a first direction or open position, shown as a clockwise direction, and in a second direction or closed direction, shown as a counter-clockwise. The first lever arm includes a catch end 168 having an exterior cam surface 170 transitioning through an apex surface 172 to an edge retention surface 174 configured to retain the striker member 102 within the latch mechanism 104 when the latch member 158 is in the closed position. The first lever arm 160 also includes an interior edge surface 176 extending from the edge retention surface 174 to the second lever arm 162.

A biasing member 178 such as a torsion spring 178 is disposed on the pivot bearing 166. The torsion spring 178 includes a first end 180 that is retained in the detent notch 148 defined in the stop tab 140 and a second end 182 engaged to second lever arm 162 of the latch member 158. The torsion spring 178 is under compression where the first end 180 is biased apart from the second end 182 such that second lever arm 162 is urged to pivot in the first direction, shown as counter-clockwise, about the pivot bearing 166 thus causing the first lever arm 160 to pivot in the closed position.

Referring back to FIG. 2, the latch mechanism 104 further includes an over-mold 184 snapped on, or fitted, over a surface of the latch member 158. FIG. 2 shows the over-mold 184 is snapped onto the latch member 158 between the frame plate 114 and latch member 158. It should be appreciated that the over-mold 184 may also be fitted onto the opposite surface of the latch member 158 without departing from the scope of the invention. It should be appreciated that the over-mold 184 may also be directly molded, or molded-in-place, onto the latch member 158 without departing from the scope of the invention.

In the embodiment shown, the over-mold 184 is a single piece mold having the a similar outline shape as the latch member 158 and includes a plurality of clips 186 that snaps onto the sides and/or exterior surface of the latch member 158 thus retaining the over-mold 184 to the latch member 158. Alternatively, the over-mold may be molded-in-place thus eliminating the need of clips 186. The over-mold 184 includes a striker retention feature 188 that nests onto the edge retention surface 174 of the latch member 158. The over-mold 184 further includes a pivot limiter bumper 190 that fits adjacent an edge surface of the second lever arm 162 that is facing the stop bumper 152.

As the striker member 102 makes contact with the cam surface 170 and rides against the cam surface 170, the first arm lever 160 is urged pivotally in the clockwise direction, or open direction, overcoming the biasing force of the torsion spring 178, thus clearing the striker member 102 to travel further within the guideway 122. The pivot limiter bumper 190 of the over-mold 184 abuts the stop bumper 152 thereby limiting the rotation of the latch member 158 about the pivot bearing 166 sufficient for the striker member 102 to clear the apex surface 172. Once the striker member 102 clears the apex surface 172, the torsion spring 178 urges the latch member 158 in the counter-clockwise direction, thus pivoting the first lever arm 160 back into the closed position. The striker guideway 122, stop bumper 152, and retention feature 188 cooperates with each other to retain and dampen the vibration of the striker member 102 within the latch mechanism 104.

Referring back to FIG. 3 as the latch member 158 is normally in the closed position where the torsion spring 178 urges the latch member 158 to pivot in a counter-clockwise direction about the pivot bearing 166, the interior edge surface 176 of the first lever arm 160 abuts the stop bumper 152 thereby limiting the pivot of the latch member 158 in the counter clockwise direction. The latching mechanism 104 is configured to allow the manual release of the striker member 102 thus allowing the panel to be opened. The first arm level 160 of the latch member 158 defines an aperture 192 for the insertion of a tool, such as the shaft of a screw driver, for apply a rotation force about the pivot bearing 166 in the clockwise direction, or open direction, overcoming the biasing force of the torsion spring 178, thus allowing the striker member 102 to be released from the latch mechanism 104. A manual operating cable or electric motor operated cable may be attached to the aperture to provide such a force for releasing the striker member 102.

The latch assembly 100 of the present disclosure offers several advantages. These include a latch mechanism 104 containing a minimum number of parts of relatively inexpensive construction, thus effecting economy of manufacture and assembly. Another advantage is that the latch mechanism 104 includes features that cooperates with the striker member 102 to securely engage the striker member 102 in a closed position while minimizing noise, hardness, and vibration during the operation of the vehicle.

It will be understood that the invention is not to be limited to the exact construction shown and described, but that various changes and modifications may be made without departing from the spirit and scope of the invention, as defined in the appended claims. The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A latch mechanism comprising:

a frame plate defining a guideway configured to receive a striker member, wherein the guideway includes an open end and a closed end opposite the open end;

a latch member pivotally connected to the frame plate, where the latch member is biased to pivot into a closed position and configured to selectively pivot into an open position;

a stop tab extending from the closed end of the guideway; and a stop bumper defining a slot configured to receive the stop tab;

wherein the stop tab is inserted through the slot thus retaining the stop bumper on the stop tab, and wherein the latch member includes a first lever arm having an interior edge surface configured to engage the stop bumper to limit the pivot of the latch member in the closed position.

2. The latch mechanism of claim 1, further comprising an over-mold fitted onto the latch member, the over-mold includes a pivot limiter bumper configured to cooperate with the stop bumper to limit the pivot of the latch member in the open position.

3. The latch mechanism of claim 2, wherein the latch member includes a first lever arm having a catch end having an edge retention surface configured to retain the striker member, and wherein the over-mold includes a striker retention feature nested onto the edge retention surface.

4. The latch mechanism of claim 1, further comprising a striker guard inserted onto the guideway.

5. The latch mechanism of claim 4, wherein the striker guard includes a pair of side surfaces, wherein at least one of the side surfaces includes a projection configured to engage a corresponding notch defined in the guideway.

6. The latch mechanism of claim 1, wherein the slot of the stop bumper includes a plurality of internal ribs compressed onto the stop tab.

7. The latch mechanism of claim 6, wherein the stop tab includes an edge surface defining a protrusion spaced from a distal end of the stop tab, and wherein the stop bumper is retained on the stop tab between the frame plate and the protrusion.

8. The latch mechanism of claim 7, wherein the latch member includes a first lever arm and a second lever arm extending from an end of the first lever arm, and wherein the latch member is pivotally attached to the frame plate with a pivot bearing located between the first lever arm and second lever arm.

9. The latch mechanism of claim 8, further comprising a torsion spring disposed on the pivot bearing, wherein the torsion spring includes a first end retained in a detent notch defined in the stop tab and a second end engaged to the second lever arm of the latch member urging the latch member into the closed position.

10. A latch assembly comprising:

a striker member;

a mounting bracket having a frame plate and a pair of mounting members extending from the frame plate, the frame plate defining a guideway having an opened end, a closed end opposite the opened end, and a pair of side surfaces extending between the opened end and closed end;

a latch member pivotally connected to the frame plate, wherein the latch member is configured to selectively pivot into a closed position and into an opened position;

a stop bumper disposed adjacent the closed end, wherein the stop bumper is configured to limit a travel of the striker member within the guideway; and a striker guard having an interior surface defining a U-shape and a pair of side surfaces extending from the interior surface along the parallel legs of the U-shape, the striker guard is inserted into the guideway such that the interior surface abuts the frame plate and the pair of side surfaces abuts a pair of corresponding edge surfaces of the guideway.

11. The latch assembly of claim 10, further comprising an over-mold fitted over the latch member, wherein the over-mold includes a pivot limiter bumper configured to cooperate with the stop bumper to limit the pivot of the latch member in the open position and a striker retention feature configured to engage the striker member in the closed position.

12. The latch assembly of claim 10, wherein the latch member includes a catch end defining an exterior cam surface transitioning through an apex surface to an edge retention surface.

13. The latch assembly of claim 10, wherein the latch member includes a first lever arm having an interior edge surface configured to engage the stop bumper to limit the pivot of the latch member in the closed position.

14. The latch assembly of claim 13, wherein the latch member further includes a second lever arm extending from an end of the first lever arm and a pivot bearing inserted at an intersection of the first and second lever arms.

15. A latch assembly comprising:

a frame plate defining a guideway configured to receive a striker member, wherein the guideway includes an open end and a closed end opposite the open end;

a latch member pivotally connected to the frame plate, where the latch member is biased to pivot into a closed position and configured to selectively pivot into an open position;

a stop tab extending from the closed end of the guideway;

a stop bumper defining a slot configured to receive the stop tab, wherein the stop tab in inserted through the slot thus retaining the stop bumper on the stop tab; and an over-mold fitted over the latch member, the over-mold includes a pivot limiter bumper configured to cooperate with the stop bumper to limit the pivot of the latch member in the open position; and wherein the latch member includes a first lever arm having a catch end having an edge retention surface configured to retain the striker member and an internal surface configured to engage the stop bumper to limit the pivot of the latch member in the closed position.

16. The latch assembly of claim 15, wherein the over-mold further includes a striker retention feature nested onto the edge retention surface of the first lever arm.

17. The latch assembly of claim 16, further comprising a striker guard having an interior surface defining a U-shape and a pair of side surfaces extending from the interior surface, wherein the interior surface is abutted against the frame plate and the pair of side surfaces are interference fitted into the guideway.

* * * * *